US006283493B1

(12) United States Patent
Arduin et al.

(10) Patent No.: US 6,283,493 B1
(45) Date of Patent: Sep. 4, 2001

(54) INTERFACE DEVICE BETWEEN A SKI AND THE ELEMENTS FOR RETAINING A BOOT ON THE SKI

(75) Inventors: Joël Arduin, Metz-Tessy; Jacques Le Masson, Villaz, both of (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/292,977

(22) Filed: Apr. 16, 1999

(30) Foreign Application Priority Data

Apr. 17, 1998 (FR) ..... 9805064

(51) Int. Cl.[7] ..... A63C 9/00

(52) U.S. Cl. ..... 280/617; 280/634; 280/636; 280/602

(58) Field of Search ..... 280/611, 617, 280/634, 636, 616, 601, 602

(56) References Cited

U.S. PATENT DOCUMENTS

| | | | | |
|---|---|---|---|---|
| 4,067,593 | * | 1/1978 | Earl | 280/617 |
| 5,046,751 | * | 9/1991 | Scherubl | 280/617 X |
| 5,129,668 | * | 7/1992 | Hecht | 280/617 X |
| 5,395,132 | * | 3/1995 | Abondance et al. | 280/617 X |
| 5,474,321 | * | 12/1995 | Pritz | 280/617 X |
| 5,480,175 | * | 1/1996 | Astier et al. | 280/617 X |
| 5,647,605 | | 7/1997 | Arduin | 280/602 |
| 5,735,541 | | 4/1998 | Fritschi et al. | 280/617 |

FOREIGN PATENT DOCUMENTS

| | | |
|---|---|---|
| 0685244 | 12/1995 | (EP) . |
| WO 96/23559 | 8/1996 | (WO) . |
| WO 96/35488 | 11/1996 | (WO) . |

OTHER PUBLICATIONS

US pending patent application 09/258,157.*

* cited by examiner

*Primary Examiner*—J. J. Swann
*Assistant Examiner*—F. Zeender
(74) *Attorney, Agent, or Firm*—Greenblum & Bernstein, P.L.C.

(57) ABSTRACT

An interface device adapted to be positioned between a ski and an assembly for retaining a boot on the ski, the device including front and rear platforms that are raised with respect to the surface defined by the upper surface of the ski. The platforms are supported by a cradle having a reduced length with respect to the volume of the platforms, each of the platforms being connected to the cradle by a bearing journal, and both platforms being connected to each other by a non-extensible connection located above the journals. The invention also relates to the combination of a retention assembly and a ski.

39 Claims, 2 Drawing Sheets

INTERFACE DEVICE BETWEEN A SKI AND THE ELEMENTS FOR RETAINING A BOOT ON THE SKI

BACKGROUND OF THE INVENTION

1. Field of the Invention

The invention relates to an interface device between a ski and the elements for retaining a boot on the ski.

The invention also relates to an assembly for retaining a boot on a ski, the assembly including the interface device as well as to a ski in combination with the interface device.

2. Description of Background and Relevant Information

In accordance with the international patent application published as No. WO 96/35488, an interface device is known which includes an elongated plate on which both the retaining elements are mounted. The plate is raised with respect to the ski. It is connected to the ski in its central portion via two projections whose spacing can be adjusted. In addition, a shock-absorbing element is wedged between each of the ends of the plate and the ski.

Such a device produces a greater concentration of pressure in the central zone of the ski. In addition, since both retaining elements are mounted on the same plate that is separate from the beam of the ski, the ski is freed from the stresses generated by the boot retaining elements.

This interface device provides satisfactory results; indeed, it allows the ski to bend naturally, and the ski follows its trajectory along a normal curve while turning.

SUMMARY OF THE INVENTION

An object of the invention is to propose an interface of the aforementioned type which further improves the natural bending of the ski especially while turning, and which makes the ski's steering smoother when there are alternating wide and narrow turns.

Another object of the invention is to propose an interface device that provides greater freedom to the ski in the area of its sliding surface.

Other objects and advantages of the invention will become apparent from the following description.

The interface device according to the invention includes front and rear platforms having mounting zones for the front and rear retaining elements, such platforms being raised with respect to the surface defined by the upper surface of the ski. The platforms are supported by a cradle whose length is reduced with respect to the volume of the platforms and provided to be affixedly connected to the ski, in that each platform is connected to the cradle via a bearing journal, and both platforms are connected to each other via a non-extensible connection located above the level of the journals.

The assembly for retaining a boot on a ski according to the invention includes a front retaining element and a rear retaining element. The retaining elements are borne by front and rear platforms, the platforms being supported by a cradle, each platform being connected to the cradle about a bearing journal, and the platforms being connected to each other via a nonextensible connection.

The ski according to the invention includes an interface device or a retention assembly such as that previously described.

BRIEF DESCRIPTION OF THE DRAWINGS

The invention will be better understood with reference to the following description and to the annexed drawings that form an integral part thereof.

DETAILED DESCRIPTION OF THE INVENTION

Figure 1:
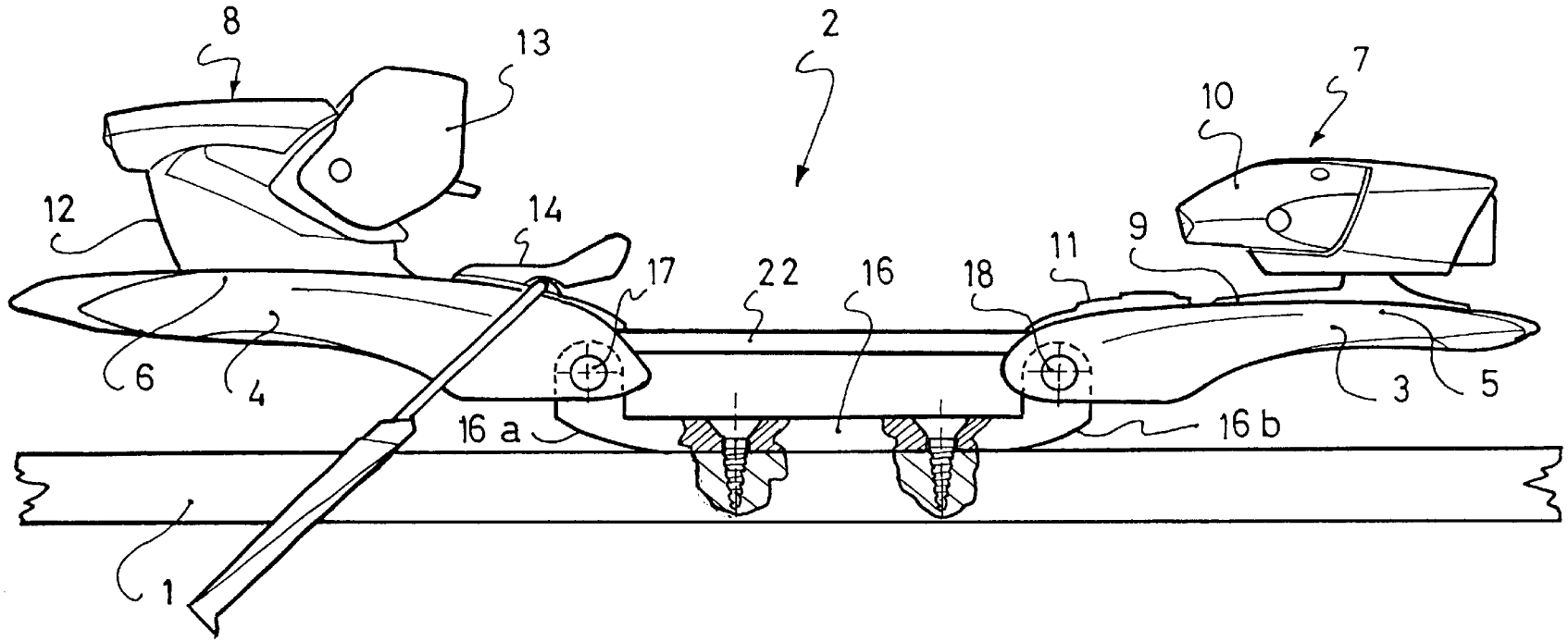
FIG. 1 is a side elevation view of the interface device according to a first embodiment of the invention.

FIG. 1 represents the median zone of a ski 1 overlaid with a device 2 according to a first embodiment of the invention.

The device 2 has a front platform 3 and a rear platform 4. Each of the two platforms has an upper mounting zone 5, 6, respectively, that is provided to receive the front 7 and rear 8 retaining elements, i.e, front and rear bindings. They are made of any appropriate material, such as from reinforcing fiber-filled plastic, for example.

The front retaining element 7 is of any appropriate type. Normally, such an element has a base 9 that is provided to be affixed on the mounting zone 5 of the platform, a body and a jaw 10 for retaining the sole of the boot. At the rear of the jaw, the element has a support plate 11 for supporting the sole of S the boot at the front.

According to an alternative embodiment, instead of being assembled to the platform, the base 9 could form, with the platform, a single element bearing both the body and the jaw of the retaining element.

Also in a known manner, the rear retaining element 8 includes a body 12 slidably mounted along a slide affixedly assembled to the rear platform 4. The body bears a jaw 13 for retaining the boot. Towards the front, the rear retaining element has a support plate 14 that provides a vertical support to the rear of the sole of the boot. In the embodiment illustrated, the support plate 14 is associated to the ski brake, although this is not restrictive.

According to the invention, both platforms 3 and 4 are raised with respect to the upper surface of the ski, and they are supported by a cradle 16 about the bearing journals 17 and 18. The cradle 16 is provided to be assembled to the ski by any appropriate means, for example, by screws. The journals 17 and 18 are respectively located to the rear of the front platform and to the front of the rear platform. Preferably, they are located between the two support plates 11 and 14 of the retaining elements. As a result, the cradle 16 has a length that is visibly less than the longitudinal volume of the retaining elements, i.e., less than the length defined by the remote ends of the retaining elements and less than the length defined by the remote ends of the platforms themselves. In a variation, instead of being affixedly connected to the ski, the cradle could rest on shock absorbing elements wedged locally between the cradle and the ski.

The journals 17 and 18 are located above the upper surface of the ski, and they are oriented along a horizontal and transverse direction with respect to the longitudinal direction defined by the ski. According to a variation, they could be oriented slightly obliquely with respect to the transverse direction of the ski.

The journals are of any appropriate type. For example, they could be a bolt, or an axle, whose two ends are crimped by chasing. Other constructions could also suffice. The journals 17, 18 leave the platforms 3, 4 free to rotate with respect to the cradle, about the respective axes along which the journals extend.

Due to its reduced length, the cradle exerts little influence on the stiffness of the sliding surface of the ski. In addition, it re-centers the support zone of the boot on the ski. The ski is freer to be deformed because of the bearing journals with the platforms. The fact that the supports of the boot on the support plates are offset towards the exterior with respect to the journals 17 and 18, has a suspension effect between the boot and the ski. A block of elastomer material Could potentially be wedged between the suspended part of one and/or the other of the platforms and the ski.

In the embodiment illustrated, the journals 17 and 18 are borne by eyes located at the front and rear of the cradle, and they cross the lateral shoulders of the front and rear platforms that come down along the eyes, on the exterior. Other methods of construction for these journals could also be adopted.

In the embodiment represented in FIG. 1, the front and rear edges 16*a* and 16*b* of the cradle 16 are raised, so as provide the ski with bending freedom along a greater length. The space between the raised edges of the cradle and the ski could potentially be filled with foam, or an elastomer material, that would prevent snow from entering in this area and would reinforce the elasticity of the ski.

Additionally, both platforms 3, 4 are connected to one another via a non-extensible connection 22 whose length is determined in accordance with the position of the journals 17 and 18 so that the front and rear platforms are substantially horizontal, in each other's extension, when the ski is at rest. The non-extensible connection 22 is located above the area of the journals 17 and 18, so that in the presence of the boot, the non-extensible connection 22 can work in traction. The connection can be an attached connection, each of the ends being fixed to the platforms by any appropriate means. It can also be a reduced section zone originating from one of the platforms, and attached to the other platform. Other methods of construction could also suffice.

It is important for the connection to be non-extensible. Conversely, it is less important for it to be or not be stiff while bending. That is, the connection opposes extension movement between the platforms 3, 4, but allows contractive movement between the platforms, i.e., a contractive, non-extensible connection. In other words, the connection 22 could be a cable, or a flexible link.

In view of the description provided above, it is to be understood that both the platforms 3,4 are kept raised with respect to the ski surface, and that they are connected to the ski via the two journals 17 and 18 located in the vicinity of the support plates.

In this way, the connection between the ski and the retaining elements is returned to a reduced length range. Also, the bearing journals provide greater freedom to the ski to bend normally.

Figure 2:
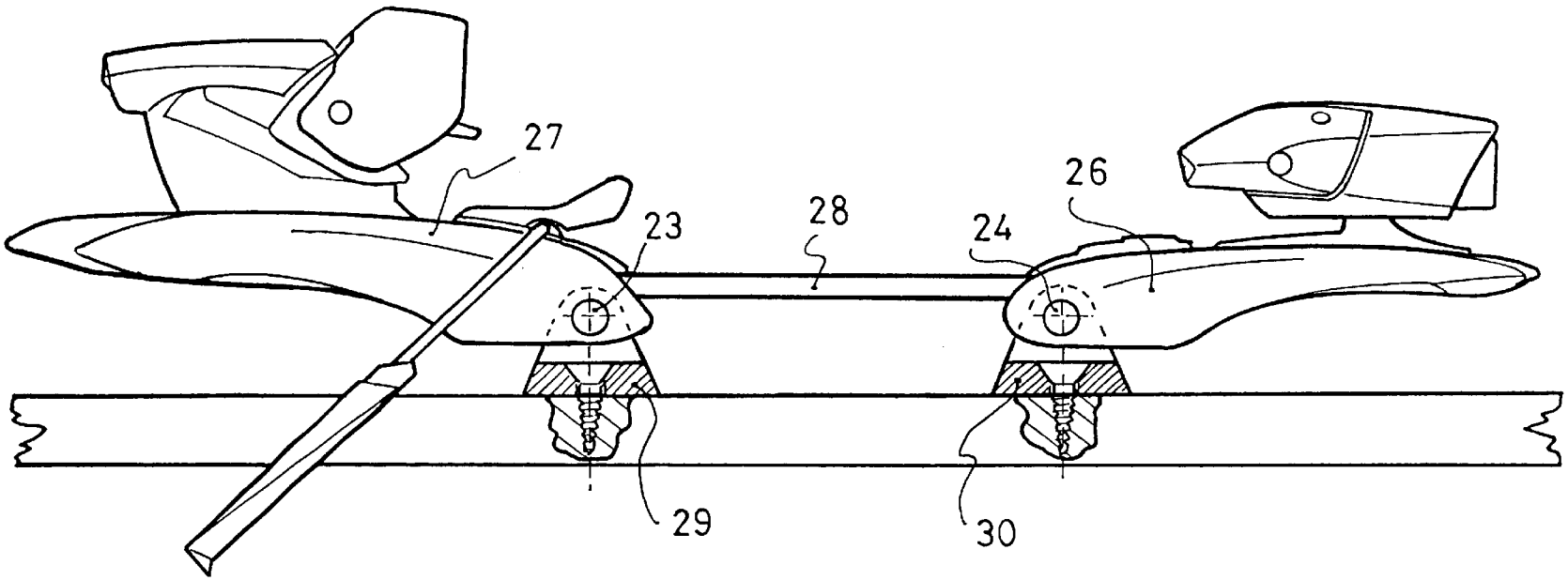
FIG. 2 is a side elevation view of an interface device according to another embodiment of the invention.

FIG. 2 relates to another embodiment of the invention.

According to this variation, the cradle is formed of two individual stirrups 29 and 30 that each bear a connecting journal 23, 24 with the platforms. Each stirrup is affixedly connected to the ski by any appropriate means, for example, by screws.

Each stirrup bears a journal, respectively 23, 24, with the front and rear platforms 26 and 27. As was the case previously, the two platforms 26 and 27 are connected via a non-extensible connection 28.

This embodiment is advantageous because the platforms are raised with respect to the ski, they are connected via journals, and the ski can bend freely along almost its entire length, including between the two stirrups 29 and 30.

The present description is not restrictive, and one could adopt other embodiments of the invention without, however, leaving the scope thereof.

In particular, the bases or the slides or the covering elements of the slides could be integrated into the platforms so as to form a single element, respectively for the front retaining element or the rear retaining element. In addition, the non-extensible connection could connect the retaining elements to one another instead of connecting the platforms.

The cradle could be assembled to the ski via an irreversible assembly means, for example, by welding or gluing. The cradle could also be integrated into the inner structure of the ski, i.e., the ski could have transverse projecting bosses bored with an opening for each of the bearing journals.

Finally, the invention can find an application not only in traditional skis, but also in short skis, i.e., whose length is comprised approximately between 0.50 and 1.50 meters.

The instant application is based upon French Patent Application No. 98.05064, filed on Apr. 17, 1998, the disclosure of which is hereby expressly incorporated by reference thereto in its entirety, and the priority of which is hereby claimed under 35 USC 119.

What is claimed is:

1. An interface device adapted to be positioned between a ski and an assembly for retaining a boot on the ski, said device comprising:

a front platform adapted to support a front binding and a rear platform adapted to support a rear binding, each of said front and rear platforms including a respective support plate for supporting the boot, said front and rear platforms adapted to be spaced above an upper surface of the ski;

a cradle adapted to be fixedly positioned on the ski, said cradle having a length less than a length defined by remote ends of said front and rear platforms;

each of said front and rear platforms being connected to said cradle by respective journals, said journal for said front platform being positioned rearward of a forward end of said support plate of said front platform, and said journal for said rear platform being positioned forward of a rear end of said support plate of said rear platform;

said front and rear platforms being connected to each other by a contractive, non-extensible connection positioned above said journals.

2. An interface device according to claim 1, wherein:

said front platform is longitudinally spaced apart from said rear platform.

3. An interface device according to claim 1, wherein:

each of said front and rear platforms is independently pivotal with respect to each other about respective ones of said journals.

4. An interface device according to claim 1, wherein:

said journal for said front platform is positioned in a rear area of said front platform, and said journal for said rear platform is positioned in a front area of said rear platform.

5. An interface device according to claim 1, wherein:

said cradle comprises a lower surface adapted to be supported by the upper surface of the ski, said cradle further comprising front and rear edges, said front and rear edges being raised with respect to said lower surface of said cradle.

6. An interface device according to claim 1, wherein:

said cradle has, at front and rear areas, support eyes for said journals.

7. An interface device according to claim 1, wherein:

said cradle comprises two longitudinally spaced apart stirrups, each of said stirrups bearing a respective one of said journals.

8. An alpine ski in combination with an interface device according to claim 1, said cradle of said interface device being fixedly positioned on said ski.

9. An alpine ski according to claim 8, wherein:

said cradle is integrated into said ski.

10. An interface device adapted to be positioned between a ski and an assembly for retaining a boot on the ski, said device comprising:

a front platform adapted to support a front binding and a rear platform adapted to support a rear binding, said front and rear platforms adapted to be spaced above an upper surface of the ski, and each of said front and rear platforms including a respective support plate for supporting the boot;

a cradle adapted to be fixedly positioned on the ski, said cradle having a length less than a length defined by remote ends of said front and rear platforms;

each of said front and rear platforms being connected to said cradle by only a single respective journal, said journal for said front platform being positioned rearward of a forward end of said support plate of said front platform, and said journal for said rear platform being positioned forward of a rear end of said support plate of said rear platform; and said front and rear platforms being connected to each other by a non-extensible connection positioned above said journals.

11. An interface device according to claim 10, wherein:

said front platform is longitudinally spaced apart from said rear platform.

12. An interface device according to claim 10, wherein:

each of said front and rear platforms is independently pivotal with respect to each other about respective ones of said journals.

13. An interface device according to claim 10, wherein:

said journal for said front platform is positioned in a rear area of said front platform, and said journal for said rear platform is positioned in a front area of said rear platform.

14. An interface device according to claim 10, wherein:

said cradle comprises a lower surface adapted to be supported by the upper surface of the ski, said cradle further comprising front and rear edges, said front and rear edges being raised with respect to said lower surface of said cradle.

15. An interface device according to claim 10, wherein:

said cradle has, at front and rear areas, support eyes for said journals.

16. An interface device according to claim 10, wherein:

said cradle comprises two longitudinally spaced apart stirrups, each of said stirrups bearing a respective one of said journals.

17. An alpine ski in combination with an interface device according to claim 10, said cradle of said interface device being fixedly positioned on said ski.

18. An alpine ski according to claim 17, wherein:

said cradle is integrated into said ski.

19. An assembly for retaining a boot on a ski, said assembly comprising:

a front platform and a rear platform, each of said front and rear platforms including a respective support plate for supporting the boot;

a front binding mounted on said front platform and a rear binding mounted on said rear platform;

a cradle adapted to be mounted on the ski, said front and rear platforms being supported on said cradle by means of a respective journal connection, said journal connection for said front platform being positioned rearward of a forward end of said support plate of said front platform, and said journal connection for said rear platform being positioned forward of a rear end of said support plate of said rear platform;

a contractive, non-extensible connection connecting said front platform to said rear platform.

20. An assembly according to claim 19, wherein:

said front platform is longitudinally spaced apart from said rear platform.

21. An assembly according to claim 19, wherein:

each of said front and rear platforms is independently pivotal with respect to each other about respective ones of said journals.

22. An assembly for retaining a boot on a ski, said assembly comprising:

a front platform and a rear platform;

a front binding mounted on said front platform and a rear binding mounted on said rear platform, each of said front and rear bindings including a respective support plate for supporting a boot;

a cradle adapted to be mounted on the ski, said front and rear platforms being supported on said cradle by means of a respective journal connection;

said journal for said front platform being positioned vertically beneath a rear area of said support plate of said front binding, and said journal for said rear platform being positioned vertically beneath a front area of said support plate of said rear binding;

a contractive, non-extensible connection connecting said front platform to said rear platform.

23. An assembly according to claim 19, wherein:

said cradle comprises a lower surface adapted to be supported by the upper surface of the ski, said cradle further comprising front and rear edges, said front and rear edges being raised with respect to said lower surface of said cradle.

24. An assembly according to claim 19, wherein:

said cradle has, at front and rear areas, support eyes for said journals.

25. An assembly according to claim 19, wherein:

said cradle comprises two longitudinally spaced apart stirrups, each of said stirrups bearing a respective one of said journals.

26. An alpine ski in combination with an assembly according to claim 19, said cradle of said assembly being fixedly positioned on said ski.

27. An alpine ski according to claim 26, wherein:

said cradle is integrated into said ski.

28. An assembly for retaining a boot on a ski, said assembly comprising:

a front platform and a rear platform, each of said front and rear platforms including a respective support plate for supporting the boot;

a front binding mounted on said front platform and a rear binding mounted on said rear platform;

a cradle adapted to be mounted on the ski, each of said front and rear platforms being connected to said cradle by only a single respective journal connection, said journal connection for said front platform being positioned rearward of a forward end of said support plate of said front platform, and said journal connection for said rear platform being positioned forward of a rear end of said support plate of said rear platform;

a non-extensible connection connecting said front platform to said rear platform.

29. An assembly according to claim 28, wherein:

said front platform is longitudinally spaced apart from said rear platform.

30. An assembly according to claim 28, wherein:

each of said front and rear platforms is independently pivotal with respect to each other about respective ones of said journals.

31. An assembly for retaining a boot on a ski, said assembly comprising:

a front platform and a rear platform;

a front binding mounted on said front platform and a rear binding mounted on said rear platform, each of said front and rear bindings including a respective support plate for supporting a boot;

a cradle adapted to be mounted on the ski, each of said front and rear platforms being connected to said cradle by only a single respective journal connection, said journal for said front platform being positioned vertically beneath a rear area of said support plate of said front binding, and said journal for said rear platform being positioned vertically beneath a front area of said support plate of said rear binding;

a non-extensible connection connecting said front platform to said rear platform.

32. An assembly according to claim 28, wherein:

said cradle comprises a lower surface adapted to be supported by the upper surface of the ski, said cradle further comprising front and rear edges, said front and rear edges being raised with respect to said lower surface of said cradle.

33. An assembly according to claim 28, wherein:

said cradle has, at front and rear areas, support eyes for said journals.

34. An assembly according to claim 28, wherein:

said cradle comprises two longitudinally spaced apart stirrups, each of said stirrups bearing a respective one of said journals.

35. An alpine ski in combination with an assembly according to claim 28, said cradle of said assembly being fixedly positioned on said ski.

36. An alpine ski according to claim 35, wherein:

said cradle is integrated into said ski.

37. An interface device adapted to be positioned between a ski and an assembly for retaining a boot on the ski, said device comprising:

a front platform adapted to support a front binding and a rear platform adapted to support a rear binding, said front and rear platforms being independent, longitudinally spaced apart, and adapted to be spaced above an upper surface of the ski, and each of said front and rear platforms including a respective support plate for supporting the boot;

a cradle adapted to be fixedly positioned on the ski, said cradle having a length less than a length defined by remote ends of said front and rear platforms;

a connection between each of said front and rear platforms and said cradle, each of said connections comprising only a single journal, said journal for said front platform being positioned rearward of a forward end of said support plate of said front platform, and said journal for said rear platform being positioned forward of a rear end of said support plate of said rear platform;

said front and rear platforms being connected to each other by a contractive, non-extensible connection positioned above said journals.

38. An assembly of said interface device according to claim 37 and said front binding and said rear binding, said front binding supported on said front platform and said rear binding supported on said rear platform.

39. An alpine ski in combination with said assembly according to claim 38, said cradle being fixedly positioned on said ski.

* * * * *